United States Patent [19]

Stilling

[11] 4,240,130

[45] Dec. 16, 1980

[54] RACEWAY FOR SIGN BOX

[76] Inventor: Johann Stilling, Apt. A1001, 1141 Royal York Rd., Islington, Canada

[21] Appl. No.: 885,960

[22] Filed: Mar. 13, 1978

[51] Int. Cl.[3] ..... F21S 3/00

[52] U.S. Cl. ..... 362/217

[58] Field of Search ..... 362/217, 223, 224, 225, 362/219, 220, 221; 40/558, 564, 541, 572

[56] References Cited

U.S. PATENT DOCUMENTS

| | | | |
|---|---|---|---|
| 2,298,824 | 10/1942 | Darley | 362/219 |
| 2,375,589 | 5/1945 | Rozier | 362/221 |
| 2,399,531 | 4/1946 | Young | 362/217 |
| 2,620,580 | 12/1952 | Dwinell | 362/217 |
| 2,873,828 | 2/1959 | Zitomer | 362/217 |

*Primary Examiner*—Monroe H. Hayes

[57] ABSTRACT

An electrical raceway for installation in an illuminated sign box of the type having a translucent sign panel is in the form of an elongated and hollow structure which provides reinforcement for such a sign box and a housing for electrical conductors. Such raceway has two series of knock-out discs for mounting both left-handed and right-handed lighting fixture receptacles. When such raceways are installed in a sign box, the lighting fixture receptacles can be mounted so that the lighting tubes extend between two such raceways completely across one of the series of knock-out discs in each such raceway thereby improving the overall illumination of the translucent sign panel, and reducing the patches of varied light intensity.

13 Claims, 4 Drawing Figures

FIG. 1
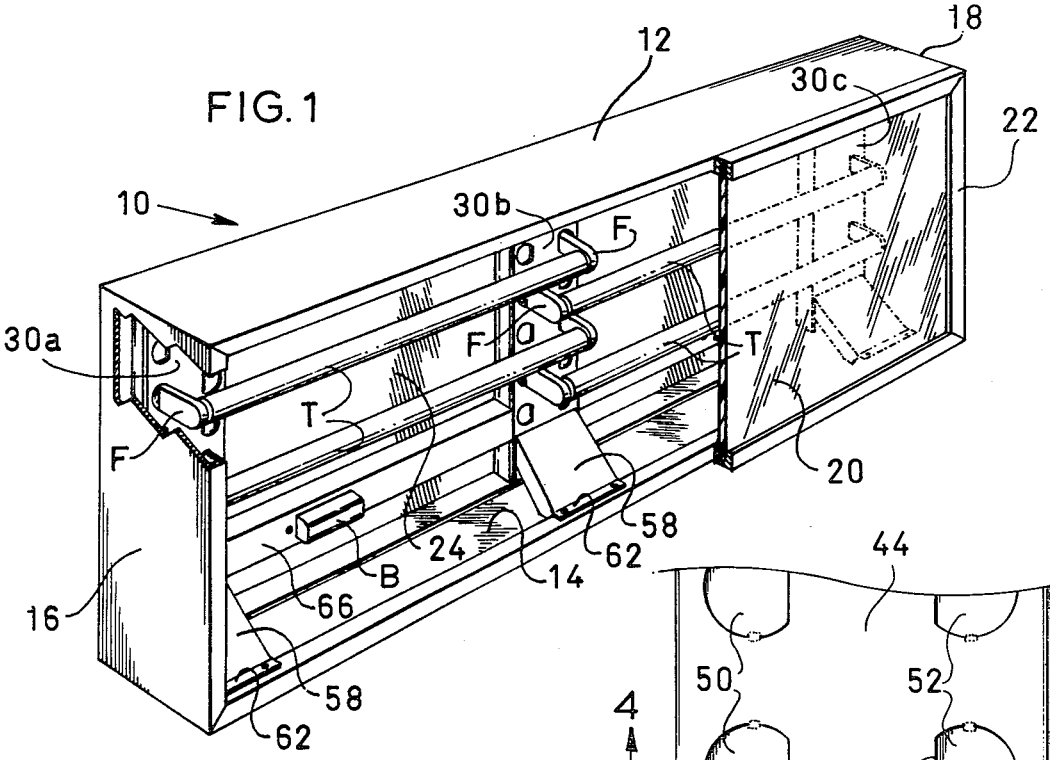
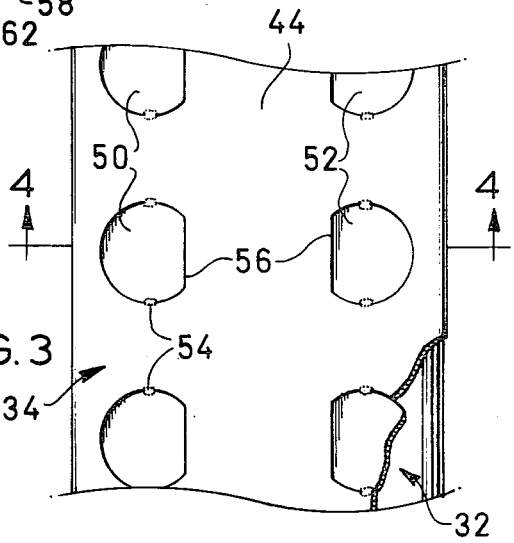
FIG. 3
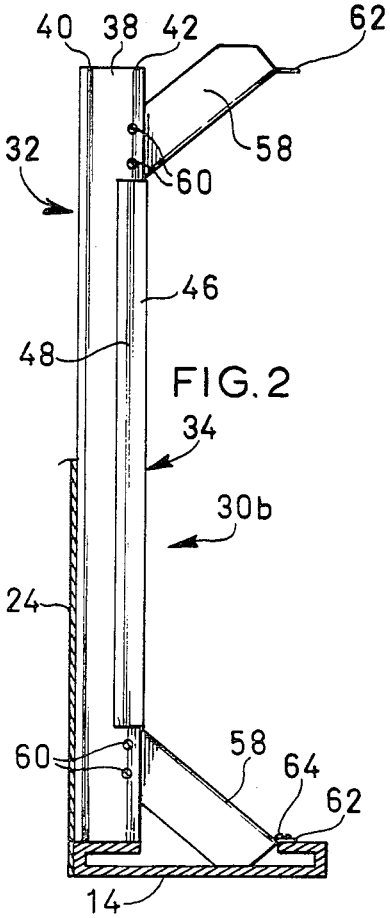
FIG. 2
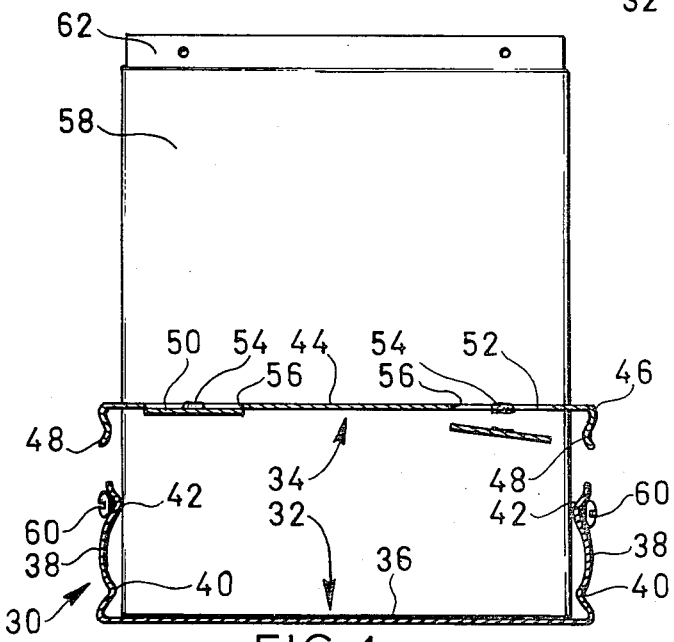
FIG. 4

RACEWAY FOR SIGN BOX

The invention relates to illuminated signs, and in particular to electrical raceways for use in the construction of sign boxes used in such illuminated signs.

Illuminated signs such as are used on storefronts, or outdoor advertising, or indoor locations such as airports, stations and the like are usually made with a generally rigid rectangular box, and a removable front panel. The removable front panel incorporates a translucent panel bearing a message or advertising printed thereon, and some form of lighting, usually fluorescent tubes, are mounted within the box portion of the sign, so as to illuminate the translucent panel.

Certain problems arise in the design and construction of such illuminated signs. In order to provide signs of varying length and height for different locations, the arrangement of lighting tubes within the box must be such that they can be extended lengthwise and up and down in a more or less completely flexible manner. However, such lighting tubes sometimes come only in a standard length, so that if the length of the sign does not correspond to the standard length, or a multiple, of the existing lighting tubes, then the arrangement of satisfactory all over illumination becomes somewhat more difficult.

In addition, signs of different heights, or bearing different messages, may require a different intensity of illumination thereby requiring a greater or lesser number of lighting tubes.

In addition to the problems of providing satisfactory illumination for such signs, it is also necessary to provide a sign box of a completely flexible design, which will have sufficient strength to permit it to be erected on a storefront, where it would be exposed to severe wind stresses. In many cases, such sign boxes will be made with top, bottom and side walls which are formed essentially of a common or standardized extrusion such as is shown for example in U.S. Pat. No. 3,863,372. By the use of such extrusions it is possible to provide signs having a uniform appearance, over a wide range of different dimensions.

However, as the dimensions increase, it is necessary to incorporate some form of additional stiffening in the form of interior ribs or braces. A variety of different braces, or channels or beams may be incorporated in the sign for the purpose.

In addition to such additional stiffening the wiring and electrical fittings or receptacles in the sign must be provided with suitable junction boxes and raceways.

When the interior of the sign box contains additional stiffening ribs and raceways, and electrical fittings, the space becomes unduly confined. This may create additional problems. It has been found that the lighting tubes must be set back from the translucent front panel by a certain distance, both for the dissipation of heat from the tubes, and also, so as to provide an even all-over illumination. If the tubes are too close then a pattern of bright lines will appear across the translucent panel.

This problem could obviously be overcome by simply making the entire sign box somewhat deeper. However, this is generally considered to be an undesirable feature. Custom and taste require that the sign box should be more or less as shallow as possible.

Accordingly, it may become difficult if not impossible to incorporate stiffening ribs as well as raceways within the box, bearing in mind the depth limitation.

In order to overcome these various problems the invention, in general, provides a sign box in which the raceways have an elongated and hollow construction to provide the stiffness or rigidity or reinforcement for the interior of the box. In addition, such raceways are provided with multi-purpose electrical connection and mounting facilities so that the lighting tubes, and the lighting fixtures carrying the tubes, may be arranged in a staggered or offset fashion so as to provide for the arrangement of lighting tubes in a more or less continuous end to end manner, and also permitting the spacing of the lighting tubes in the vertical direction in a flexible and versatile manner so as to provide even all-over illumination of the panel to the desired lighting intensity.

Broadly, the present invention provides an electrical raceway for incorporation in a sign box to provide structural reinforcement to such a sign box when incorporated therein so as to extend between spaced apart walls thereof, for the mounting of receptacles for elongated electrical lighting tubes in a plurality of different positions and for housing electrical conductors connected to such receptacles for the supply of electricity thereto and which raceway comprises an elongated and hollow structure adapted to be disposed within such a sign box between such spaced apart walls thereof with such electrical conductors disposed therewithin and having a front wall formed with a series of electrical receptacle opening zones adapted selectively to have electrical lighting fixture receptacles secured therein.

In accordance with a preferred feature of this invention, the front wall of such an electrical raceway is formed with two mutually parallel said series of electrical receptacle opening zones, the zones of a first said series being adapted to have left-handed receptacles mounted therein and the zones of a second said series being adapted to have right-handed receptacles mounted therein. The opening zones of such two series can then have lighting fixture receptacles mounted therein so that elongated lighting tubes fitted in such receptacles mounted in said zones of said first said series extend across said zones of said second said series, and vice-versa. In this way, the invention also permits the installation of lighting tubes in sign boxes of non-standard lengths.

Usefully, an electrical raceway in accordance with this invention comprises a channel having a base web with mutually spaced apart side walls projecting forwardly therefrom and a front cover releasably secured on said channel and comprising said front wall and side edge flanges adapted releasably to engage said side walls of said channel.

To ensure adequate reinforcement of the sign box, each such side wall of the channel of the raceway is preferably formed with a least one longitudinally extending reinforcing rib which is usefully positioned so that it will releasably engage a reinforcing rib provided in a respective one of the side edge flanges of the cover so as releasably to retain that cover in position on the channel.

While the opening zones provided in the front wall of an electrical raceway in accordance with this invention can have any desired configuration, it is preferred at this time that each such opening be in the form of a major segment of a circle, each such segment being defined in part by a chord, the chords of the opening zones of each said series in the preferred embodiment then preferably being co-linear.

In accordance with a particularly preferred feature of this invention, the chords partially defining the opening zones of one of the series of such zones of a raceway with two such series of zones are disposed in transverse alignment with the chords partially defining the opening zones of the other of said series thereof. Generally, the major segments of the opening zones of such first and second series will be disposed on opposite sides of and outwardly of the chords defining the first and second series of such zones.

When used herein and in the appended claims, the expression "opening zones" is intended to embrace not only actual openings in the front wall of a raceway as provided by this invention but also knock-out or releasably retained portions of such front wall and which portions can be removed, as desired, to provide such actual openings.

An electrical raceway in accordance with this invention is usefully provided at its ends with diagonally projecting struts adapted to be secured to the walls of a sign box to provide greater reinforcement thereto.

The present invention additionally embraces a sign box comprising a rear panel and mutually spaced apart walls and which sign box has at least two electrical raceways as previously defined secured therewithin and extending between the walls thereof in mutually spaced apart and mutually parallel disposition.

In general, such a sign box will normally be provided with at least three electrical raceways of the preferred construction as previously defined, two end ones of such raceways being secured within the sign box generally at opposite ends thereof and an intermediate one of such raceways being secured within the sign box between such ends thereof. Lighting fixture receptacles are then fitted in the opening zones of the raceways so that elongated lighting tubes such as fluorescent tubes can be installed in such receptacles so that each tube extends from one of said end raceways to the intermediate raceway completely across one of said series of opening zones in the intermediate raceway.

When a sign box is provided in accordance with this invention with two intermediate electrical raceways of the aforementioned preferred construction involving the provision in each such intermediate raceway of two series of opening zones, the receptacles may be mounted on such raceways so that lighting tubes extend from one end raceway to one of the intermediate raceways completely across the other of the intermediate raceways.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

In the drawings:

FIG. 1 is a perspective illustration of an illuminated sign according to the invention partially cut away to reveal the interior;

FIG. 2 is a side elevation of one embodiment of a raceway according to the invention;

FIG. 3 is a front elevation of a portion of the raceway of FIG. 2, and,

FIG. 4 is a sectional view along the line 4—4 of FIG. 2.

Referring now to FIG. 1, the sign box according to the invention is shown generally at 10, and has a top wall 12, a bottom wall 14, a left-hand end wall 16 and a right-hand end wall 18.

A translucent front panel 20, usually of plastic or the like and carrying a message or advertising sign is mounted in a frame 22. The frame 22 is usually hingedly attached to the top wall 12 of the sign 10.

The sign 10 also incorporates a relatively thin sheet metal back wall 24.

All of these features are well known, and are disclosed in for example U.S. Pat. No. 3,863,372.

Within the interior of the sign 10 there are provided, for example, four lighting tubes T. They are of course any of a variety of standard lighting tubes, which come in different, but standardized lengths.

Such lighting tubes T are mounted in standardized lighting fixtures or receptables F all of which are well known in the lighting art.

In accordance with the invention, three vertically arranged electrical raceways 30 a, b and c are provided, in spaced apart relation along the length of the sign 10. While three such raceways are shown, it will be appreciated that in the case of a shorter sign 10 it may only be necessary to have raceways at either end, where for example the sign corresponds to the standardized length of a lighting tube.

However in the majority of cases where the sign is longer than the standardized length of such lighting tubes, then a minimum of three such raceways must be provided. In the case of very long signs, then it may be necessary to provide even more such raceways 30.

The raceways 30*a* and 30*c* at the ends 16 and 18 are designated as end raceways, and the raceway 30*b* generally at the centre of the sign 10 is designated as an intermediate raceway.

The end raceway 30*c* at the right-hand end 18 of the sign 10 is of course hidden from view by the front panel 20, and is simply shown in phantom for sake of completeness.

Referring now to FIGS. 2, 3 and 4, each of the raceways 30 will be seen to comprise a channel portion 32 and a top cover 34. The channel 32 has a bottom wall 36 and two side walls 38. The side walls 38 are formed with lower ribs 40, adjacent the junction with the bottom wall 36 and upper ribs 42 adjacent the free edges.

The top cover 34 consists of a generally flat planar top wall 44 and side edge flanges 46 formed with ribs 48 therein.

The ribs 48 are shaped to interfit with the ribs 42 on the side walls 38 of the channel 32 thereby providing a snap closure for the open side of the channel 32.

The top wall 44 of the cover 34 is provided with pairs of right-handed and left-handed electrical receptacle openings 50 and 52 respectively. The openings 50 permit electrical receptacles F to be mounted therein facing towards the right-hand end 18 of the box 10, and the openings 52 permit electrical receptacles F to be mounted therein facing the left hand end 16 of the sign box 10. It will of course be appreciated that the openings 50 and 52 are in fact generally disc-like portions of metal partially stamped out from the top wall 44 in a manner well known in the electrical fitting art, being retained in position by small residual tongue portions 54 of such metal. Such disc portions can simply be knocked out by the electrician, as desired, and as shown for the right-hand disc in FIG. 4.

It will be noted that the openings 50 and 52 are formed with straight edges or chords 56 thereby providing a means for locating the particular fixture F in position so that it cannot twist around.

As best shown in FIG. 2, angle struts 58 are usefully provided at the upper and lower ends of the channel 32. The angle struts 58 make a snug fit between the side walls 38 of the channels 32, and are fastened to those side walls 38 for example by sheet metal screws 60 or the like.

The free ends of the struts 58 are provided with engagement means such as the tongues 62 by means of which they may be fastened securely, for example, by screws 64, to the interior of the top and bottom walls 12 and 14 respectively as shown in FIG. 1. The lower end of the raceway **30*b* is shown in FIG. 2 as being secured to the bottom wall 14 of one particular construction for the sign box 10 but, since the structure of the sign box 10** itself forms no part of this invention, that structure will not be described in further detail herein.

In use, the two end raceways **30*a* and 50*c* are mounted at the ends 16 and 18 of the sign box 10, by fastening the flanges 62 to the top and bottom walls 12 and 14** respectively, and by any other suitable intermediate fastening as may be required.

The intermediate raceway **30*b* is then fastened in position so as to permit the mounting of lighting tubes T between the intermediate raceway 30*b* and the end raceways 30*a* and 30*c***.

Electrical receptacles F are then fastened in selected openings 50 and 52 respectively.

It will of course be appreciated that the electrical receptacles F in the end raceway **30*a* in the left-hand end 16 will be mounted in selected ones of the openings 50, and will face towards the right-hand end 18**.

The electrical receptacles F in the raceway **30*c* at the end 18, will be mounted in the openings 52, and will face toward the left-hand end 16. Such receptacles F at the two ends 16 and 18** will not however register vertically with one another, at least in the configuration shown in FIG. 1.

The electrical receptacles in the intermediate raceway **30*b* will be arranged, so that as shown in FIG. 1, the receptacles mounted in the right-hand openings 52 thereof face towards the left-hand end 16 of the sign 10, and register with the receptacles F in the raceway 30*a* at the end 16**.

Other receptacles will be mounted in the openings 50 of the intermediate raceway **30*b* to face toward the right-hand end 18 of the box 10, and to register with the receptacles F in the raceway 30*c* at the right-hand end 18**.

The receptacles F mounted in the openings 50 and 52 of the intermediate raceway **30*b*** will be offset with one another so as to permit lighting tubes to overlap as will readily be understood by reference to FIG. 1.

In this way, it becomes possible to provide a pattern of lighting tubes T which provides for continuous overall lighting of the front panel 20.

As explained above, the arrangement of FIG. 1 presupposes that the sign box 10 can be spanned by two lengths of tubes T. In practice however it may well be that a lighting box will require three or even more lengths of tubes T in which case, there will simply be one or more further intermediate raceways **30*b*** as required.

It is also to be understood that while sets of only two tubes T are shown between the top and bottom walls 12 and 14, it may well be that if the top and bottom walls 12 and 14 are further apart, then sets of three or more such tubes T will be required. Similarly, if a greater lighting intensity is required through the front panel 20, then more tubes T will be incorporated.

Wiring may be connected between the raceways 30 in any appropriate manner, for example, by the use of horizontal raceways 66 on which the ballasts B for the tubes T may be mounted.

While the foregoing description is deemed to be the best mode contemplated for the application of the inventive principles, it will be understood that the invention is not to be considered as confined to such best mode. The invention is however claimed to be comprised as follows;

The embodiments of the invention in which an exclusive property or privilege is claimed are defined as follows:

1. An electrical raceway for incorporation in a sign box to provide structural reinforcement to such sign box when incorporated therein so as to extend between spaced apart walls thereof, for the mounting of receptacles for elongated electrical lighting tubes in a plurality of different positions and for housing electrical conductors connected to such receptacles for the supply of electricity thereto and which raceway comprises:

an elongated channel having a base web with mutually spaced apart side walls projecting forwardly therefrom;

a front cover releasably secured on said channel;

side edge flanges adapted releasably to engage said side walls of said channel, and being adapted to be disposed within such a sign box between such spaced apart walls thereof with such electrical conductors disposed therewithin, and, two mutually parallel series of electrical receptacle opening zones formed in said front cover, the zones of a first said series being adapted to have left-handed receptacles mounted therein and the zones of a second said series being adapted to have right handed receptacles mounted therein, said zones being arranged offset from one another so that elongated lighting tubes fitted in such receptacles mounted in said zone of said first said series extend across said zone of said second said series, and vice-versa.

2. An electrical raceway as claimed in claim 1 and in which said channel is formed in each said side wall thereof with at least one longitudinally extending reinforcing rib.

3. An electrical raceway as claimed in claim 2 and in which each said side flange of said cover is formed with a longitudinally extending rib adapted releasably to engage a said reinforcing rib on a respective one of said side walls of said channel so as to retain said cover releasably in position on said channel.

4. An electrical raceway as claimed in claim 3 and in which each said side wall of said channel is formed with two said longitudinally extending reinforcing ribs which are mutually spaced apart.

5. An electrical raceway as claimed in claim 1 and in which each said opening zone is a major segment of a circle, each such segment being defined in part by a chord, the chords of the opening zones of each said series being co-linear.

6. An electrical raceway as claimed in claim 5 and in which the chords partially defining the opening zones of one of said series thereof are disposed in transverse alignment with the chords partially defining the opening zones of the other of said series thereof.

7. An electrical raceway as claimed in claim 5 and in which said major segments of said opening zones of said first and second series of said opening zones are disposed on opposite sides and outwardly of said chords defining said opening zones of said first and second series.

8. An electrical raceway as claimed in claim 5 and in which each said opening zone is in the form of an actual opening in said front wall.

9. An electrical raceway as claimed in claim 5 and in which each said opening zone contains a front wall portion detachably retained in position.

10. An electrical raceway as claimed in claim 5 and which additionally comprises diagonally projecting mounting struts secured to said channel at ends thereof.

11. A sign box comprising a rear panel and mutually spaced apart walls and having at least two electrical raceways as claimed in claim 1 secured therewithin and extending between said walls thereof in mutually spaced apart and mutually parallel disposition.

12. A sign box comprising a rear panel and mutually spaced apart walls and having at least three electrical raceways as claimed in claim 1 secured therewithin to extend between said walls thereof in mutually parallel and mutually spaced apart disposition, said raceways having electrical lighting fixture receptacles mounted in said opening zones for the installation of elongated electrical lighting tubes so that each such lighting tube extends partially across said front wall of one of said raceways.

13. A sign box as claimed in claim 12, in which two end one of said electrical raceways are secured within said sign box generally at opposite ends thereof, in which an intermediate one of said electrical raceways is secured within said sign box between said ends thereof, and in which said raceways are fitted in said opening zones thereof with receptacles adapted to receive elongated electrical lighting tubes extending from one of said end ones of said electrical raceways to said intermediate raceway completely across one of said series of opening zones in said intermediate electrical raceway.

* * * * *